US006995728B2

(12) United States Patent
Rodriguez

(10) Patent No.: US 6,995,728 B2
(45) Date of Patent: Feb. 7, 2006

(54) DUAL RIDGE HORN ANTENNA

(75) Inventor: Vicente Rodriguez, Cedar Park, TX (US)

(73) Assignee: ETS Lindgren, L.P., Cedar Park, TX (US)

( * ) Notice: Subject to any disclaimer, the term of this patent is extended or adjusted under 35 U.S.C. 154(b) by 0 days.

(21) Appl. No.: 10/921,068

(22) Filed: Aug. 18, 2004

(65) Prior Publication Data

US 2005/0078044 A1 Apr. 14, 2005

Related U.S. Application Data

(60) Provisional application No. 60/496,175, filed on Aug. 19, 2003.

(51) Int. Cl.
*H01Q 13/00* (2006.01)

(52) U.S. Cl. ..... 343/786

(58) Field of Classification Search ..... 343/786, 343/771, 772, 773, 774
See application file for complete search history.

(56) References Cited

U.S. PATENT DOCUMENTS

| | | | | | |
|---|---|---|---|---|---|
| 3,829,863 | A * | 8/1974 | Lipsky | 343/773 |
| 4,225,869 | A * | 9/1980 | Lohrmann | 343/773 |
| 4,835,542 | A * | 5/1989 | Sikina, Jr. | 343/802 |
| 4,841,308 | A * | 6/1989 | Terakawa et al. | 343/771 |
| 4,890,117 | A * | 12/1989 | de Ronde | 343/773 |
| 5,214,394 | A * | 5/1993 | Wong | 330/286 |
| 5,534,880 | A * | 7/1996 | Button et al. | 343/774 |
| 6,154,182 | A * | 11/2000 | McLean | 343/773 |
| 6,268,834 | B1 * | 7/2001 | Josypenko | 343/773 |
| 6,697,027 | B2 * | 2/2004 | Mahon | 343/781 CA |
| 6,759,992 | B2 * | 7/2004 | Knop et al. | 343/786 |

* cited by examiner

*Primary Examiner*—Shih-Chao Chen
*Assistant Examiner*—Huedung X. Cao
(74) *Attorney, Agent, or Firm*—Patrick Stellitano

(57) ABSTRACT

The present invention provides apparatus and methods for a ridge horn antenna that exhibits improved directivity and main lobe of the radiation pattern at the high end of the frequency range for which its gain remains usably high, while providing a relatively low VSWR across the frequency range of operation.

20 Claims, 14 Drawing Sheets

DUAL RIDGE HORN ANTENNA

PRIORITY CLAIM

This application claims priority of U.S. Provisional Application Ser. No. 60/496,175, filed on 08/19/2003.

TECHNICAL FIELD OF THE INVENTION

The present invention relates to the field of RF antennas and, in particular, dual ridge horn antennas.

BACKGROUND OF THE INVENTION

Among the simplest and probably most widely used antennas is the horn, with applications including use as a feed element for dish antennas, reflectors and lenses, as elements of phased array antennas, for calibration and gain measurements of other antennas and devices, and for electromagnetic compatibility (EMC) testing. The widespread applicability of horns arises from its relative simplicity, ease of construction, ease of excitation, versatility, large gain and performance.

Horn antennas are essentially flared waveguides that produce a uniform phase front larger than the waveguide itself. A commercially available horn antenna is the Model 3115, manufactured by ETS Lindgren. See http://www.ets-lindgren.com/. A three dimensional view of this antenna is shown in FIG. 1. FIG. 2 shows a bottom view, side view and rear view of the Model 3115. This antenna comprises a connection assembly 1000, an upper plate 1100, a lower plate 1200, and side plates 1001 and 1002. The dimensions shown are nominal dimensions for the ridged horn antenna designed for operation in the 1 to 18 giga-Hertz (gHz) frequency band. Thus, upper and lower plates 1100, 1200 are nominally 9.63 inches wide at the wide end 1210 of the flare and 3.63 inches at the narrow end 1220 (bottom view). Upper plate 1100 and lower plate 1200 are each at an angle of +/−13 degrees, 14 minutes from the horizontal, extending 6 inches from connection assembly 1000. This is referred to herein as a pyramidal horn since the horn formed by the plates is flared in both the E-plane and the H-plane. Connection assembly 1000 provides a connection 1050 to couple power to the antenna from a coaxial cable (not shown). A threaded stud 1003 is provided for mounting the antenna.

FIG. 1 also shows a ridge 1250 attached to lower plate 1200. A second ridge 1150 of identical contour is attached to upper plate 1100. A side view and an edge view of a ridge 1150 or 1250 are shown in FIG. 3. The ridge exhibits a nominal edge thickness of 0.3550 inches and a nominal length of 7.5 inches. The ridge also exhibits a curvature or flare with nominal coordinates in inches as follows:

| | | | | | | | | |
|---|---|---|---|---|---|---|---|---|
| X | 0.000 | 0.5000 | 1.000 | 1.500 | 2.000 | 2.500 | 3.000 | 3.500 |
| Y | 0.000 | 0.000 | 0.016 | 0.032 | 0.049 | 0.085 | 0.133 | 0.200 |
| X | 4.000 | 4.500 | 5.000 | 5.500 | 6.000 | 6.500 | 7.000 | |
| Y | 0.290 | 0.422 | 0.605 | 0.875 | 1.265 | 1.855 | 2.695 | |

At its widest point, the ridge is 1.66 inches wide. Further, the ridge termination 1151 coincides with the end 1210 of a plate 5100, 5200.

The implementation of ridges 1150 and 1250 vastly extends the usable bandwidth of the basic horn antenna. Adding ridges to the horn antenna increases its bandwidth by lowering the cut off frequency of the dominant mode, while raising the cut off frequency of the next higher order mode. A gain pattern for the Model 3115 antenna is shown in FIG. 4, which shows a substantial gain over the frequency range between one and eighteen gHz. The Voltage Standing Wave Ratio (VSWR) for this frequency range is shown in FIG. 5, and the half power beam width is shown in FIG. 6.

A typical normalized radiation pattern of the ridge horn antenna is shown in FIGS. 7, 8 and 9, corresponding to 3, 12, and 17 gHz respectively. The preferred pattern is one in which the maximum power is delivered on the main axis (zero degrees), with monotonically decreasing power over a wide angular sector off the main axis. As shown in FIGS. 7, 8, and 9, as frequency increases, the main lobe of the antenna pattern becomes narrower and side lobes increase in power. Moreover, as reported in a recent technical journal, when the frequency of operation increases, the amplitude of off-axis side lobes increases and eventually surpasses the on-axis power. See IEEE Transactions on Electromagnetic Compatibility, Vol. 45, No. 1, February 2003, pages 55–60, Bruns, et.al.

Thus, although the standard ridged horn antenna provides usably high gain over a very broad frequency range, its directivity deteriorates at the high frequency end of that range. This is undesirable in most applications especially when the ridged horn antenna is used for calibration, gain measurements, or EMC testing. For EMC Immunity or susceptibility measurements it is also desirable to have the main lobe of the pattern wide enough to illuminate the equipment being tested, the narrow beam of the 3115 antenna is not well suited for this purpose. Improvement of an antenna's directivity without an increase in the VSWR within the frequency range of operation is difficult. Thus, what is needed is a ridged horn antenna that exhibits improved directivity at the high end of the frequency range for which its gain remains usably high, while providing a relatively low VSWR across the frequency range of operation.

SUMMARY OF THE INVENTION

Accordingly, the present invention presents methods and apparatus for directivity enhancement of a ridged horn antenna that overcome limitations of the prior art. More particularly, a ridged horn antenna, and method of design there for, is presented that exhibits superior directivity at the high end of the frequency range for which its gain remains usably high, while providing a relatively low VSWR across the frequency range of operation.

According to an aspect of the invention, ridges of a ridged horn antenna are provided that exhibit a pronounced curvature extending beyond the end of the plates that form the flared horn.

According to another aspect of the invention, the curvature of a ridge exhibits an arc that is tangent to a line perpendicular to a surface of the plate to which the ridge is affixed.

According to another aspect of the invention, the curvature of a ridge exhibits an acute arc that terminates on a surface of the plate to which it is affixed, the arc being tangent to a line perpendicular to a surface of the plate.

According to another aspect of the invention, an aperture of smaller dimension and a smaller antenna length are achieved.

According to another aspect of the invention the side plates of the pyramidal horn structure are eliminated as they affect the behavior of the main beam.

The foregoing has outlined rather broadly aspects, features and technical advantages of the present invention in order that the detailed description of the invention that follows may be better understood. Additional aspects, features and advantages of the invention will be described hereinafter. It should be appreciated by those skilled in the art that the disclosure provided herein may be readily utilized as a basis for modifying or designing other structures for carrying out the same purposes of the present invention. Persons of skill in the art will realize that such equivalent constructions do not depart from the spirit and scope of the invention as set forth in the appended claims, and that not all objects attainable by the present invention need be attained in each and every embodiment that falls within the scope of the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 10:
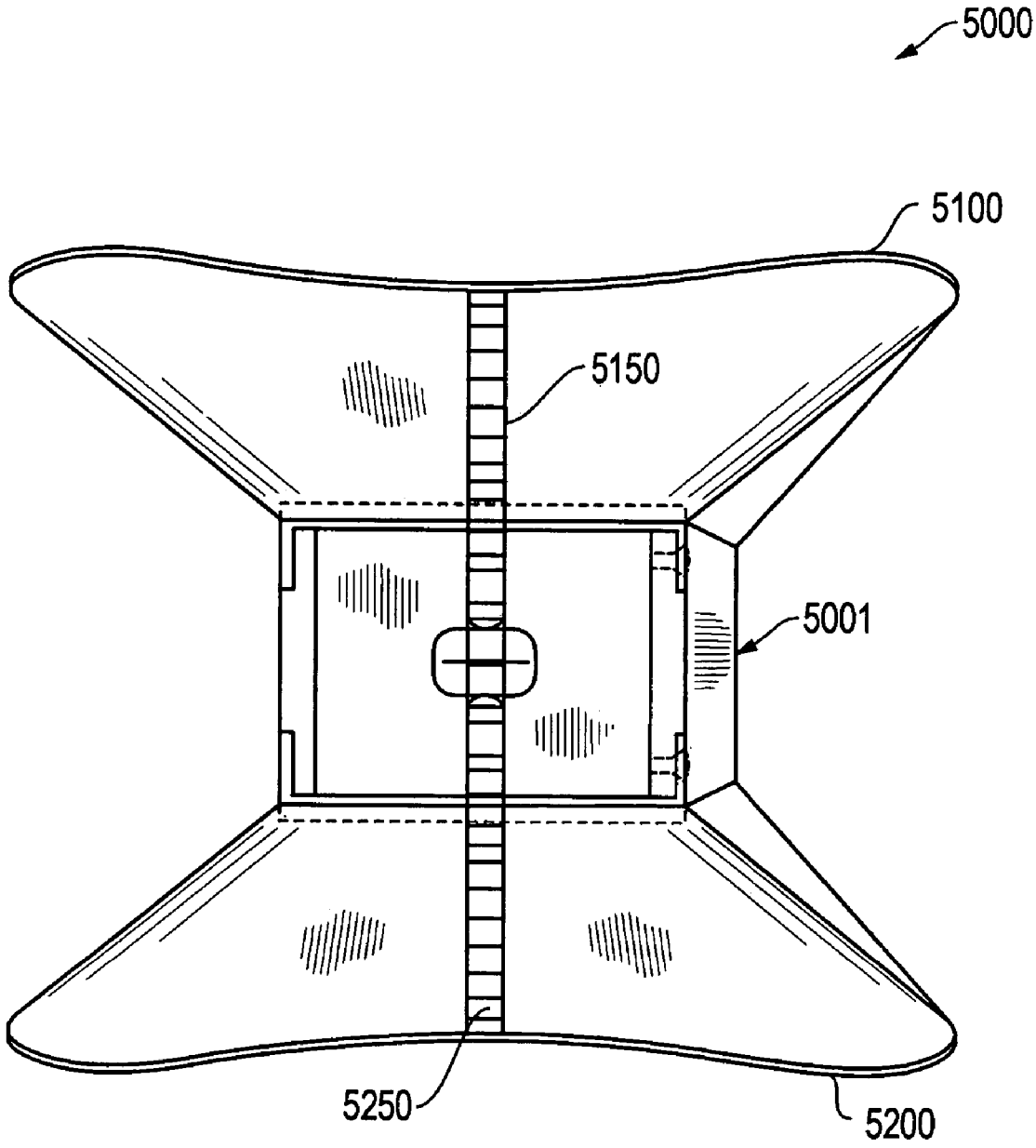
FIG. 10 is a 3-dimensional view of a preferred embodiment of the ridged horn antenna of the present invention.
Figure 11:
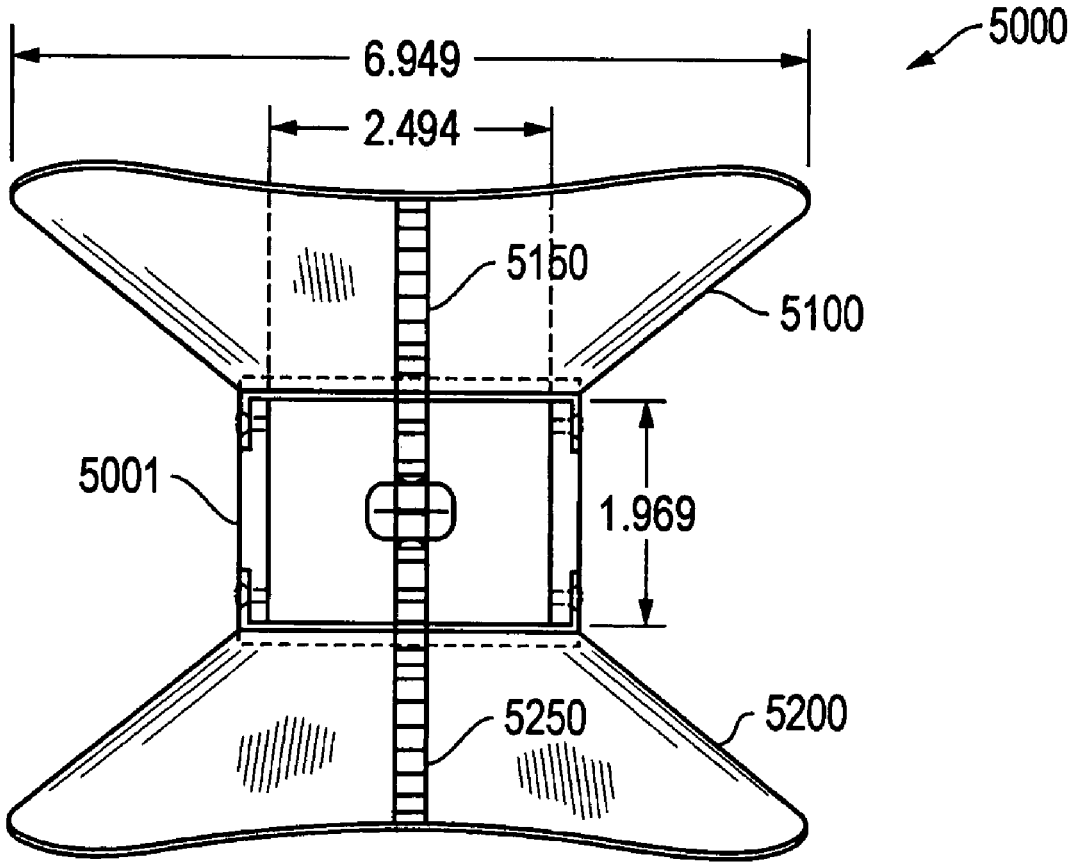
FIG. 11 shows an aperture view of a preferred embodiment of the ridged horn antenna of the present invention.

A 3-dimensional view of a preferred embodiment of a ridged horn antenna 5000 of the present invention is shown in FIG. 10. An aperture view is shown in FIG. 11. The embodiment comprises an upper plate 5100 and a lower plate 5200 that are affixed to a cavity assembly 5001. Cavity assembly 5001 is preferably rectangular in cross-section and is open at one end. Affixed to upper plate 5100 is an upper ridge 5150 and affixed to lower plate 5200 is a lower ridge 5250.

Figure 12:
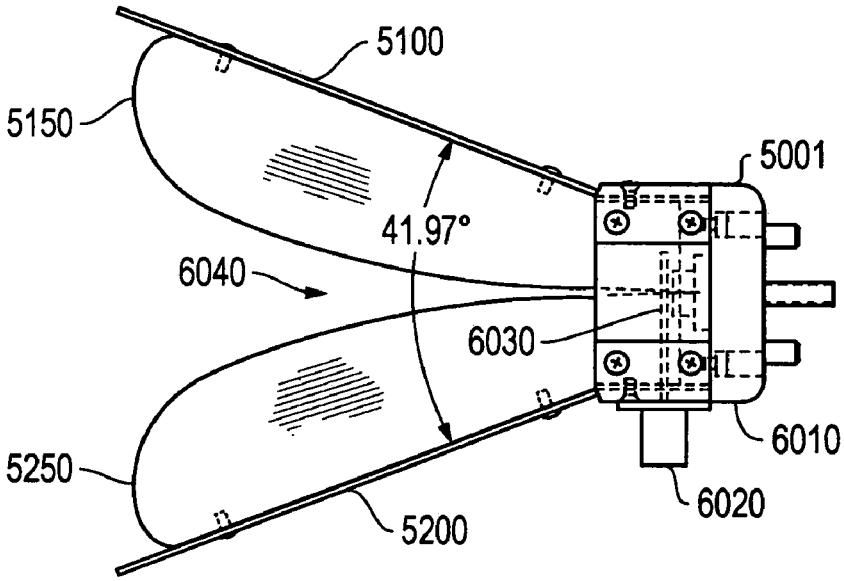
FIG. 12 shows a side view of a preferred embodiment of the ridged horn antenna of the present invention.

A side view of the preferred embodiment of antenna 5000 is shown in FIG. 12, comprising upper plate 5100, lower plate 5200, upper ridge 5150, lower ridge 5250, and cavity assembly 5001. The angle between upper and lower plates 5150 and 5250 is nominally 41.97 degrees in the preferred embodiment as shown in FIG. 12. In a side 6010 of cavity assembly 5001 is a fitting 6020, such as a precision type N jack, to receive a coaxial cable (not shown) to deliver RF power to antenna 5000. The center conductor 6030 of the coaxial feed inserts through a hole in lower ridge 5250, through the gap 6040 between upper and lower ridges 5250 and 5150, and terminates in upper ridge 5150.

Figure 13:
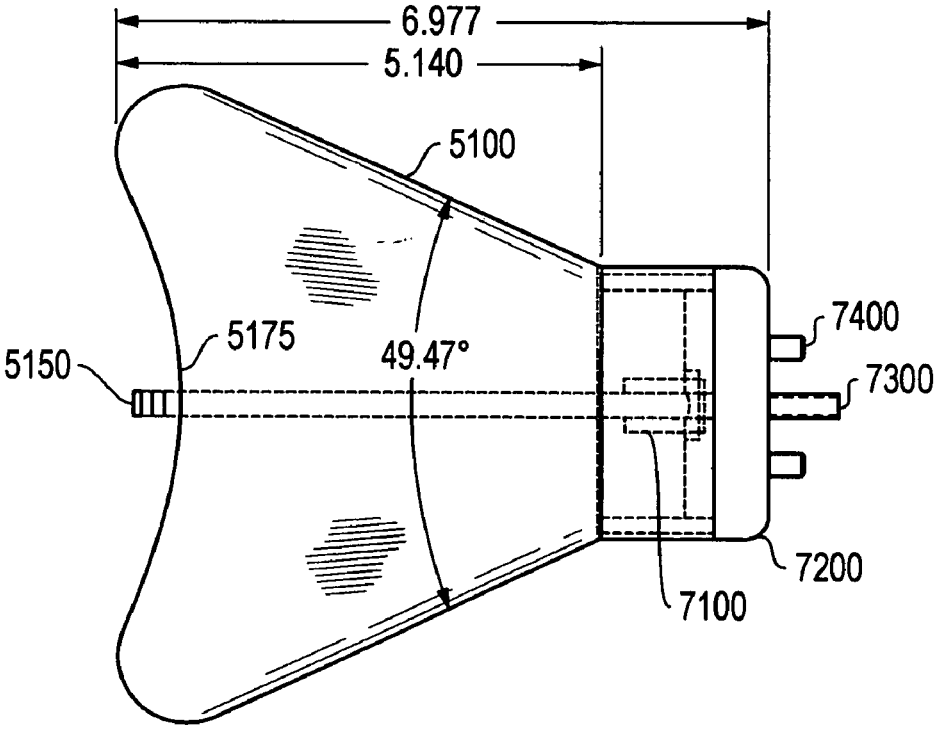
FIG. 13 shows a top view of a preferred embodiment of the ridged horn antenna of the present invention.

Upper plate 5100, upper ridge 5150, and cavity assembly 5001 are shown in FIG. 13, which is a top view of the preferred embodiment of antenna 5000. Also shown is a tuning tongue 7100 for higher order mode suppression. The dimensions of the tongue are nominally 800 mils long by 620 mils and being 15 mils in thickness, the tongue has a notch centered on the width that is 320 mils by 700 mils deep for this embodiment. Directly behind the tongue is a smaller interior cavity formed in the inner rear wall of cavity assembly 5001 for additional control over the characteristics of the antenna, such as for example reducing the VSWR of the antenna. The dimensions of this interior cavity are 163 mils deep by 800 mils by 500 mils.

Further, extending from the rear 7200 of cavity assembly 5001 is a threaded stud 7300 for centering and mounting antenna 5000, as well as indexing pins 7400 for alignment. Note, as indicated in FIG. 13, that upper and lower ridges 5150 and 5250 extend beyond the edges 5175 of upper and lower plates 5100 and 5200, respectively.

Figure 14:
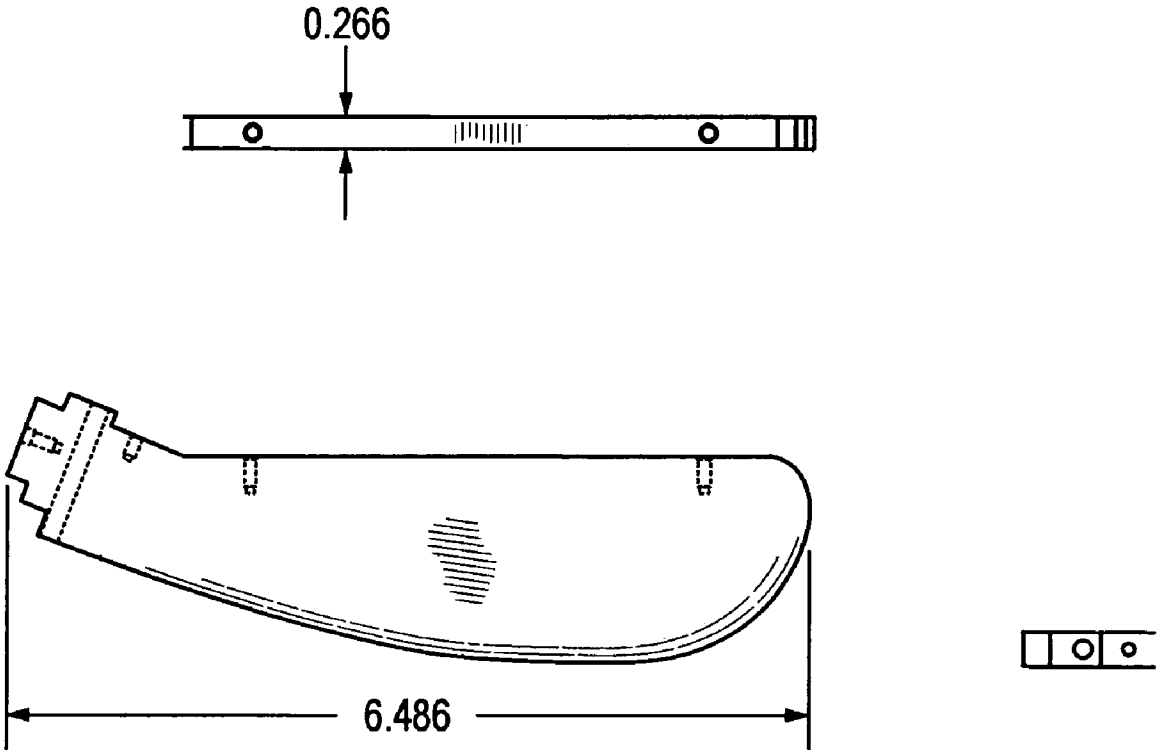
FIG. 14 shows a side view and edge view of a preferred embodiment of a ridge for the present invention.

FIG. 14 is a side view and an edge view of a ridge 5150 or 5250 of the present invention. Each ridge exhibits a nominal edge thickness of 0.266 inches and a nominal length of 6.486 inches. The ridge also exhibits a curvature or flare with nominal coordinates in inches as follows:

| | | | | | | | | | | | |
|---|---|---|---|---|---|---|---|---|---|---|---|
| X | 0.249 | 0.679 | 1.395 | 1.750 | 2.110 | 2.473 | 2.841 | 3.215 | 3.592 | 3.983 | 4.780 |
| Y | 1.102 | 1.268 | 1.516 | 1.639 | 1.748 | 1.848 | 1.936 | 2.007 | 2.071 | 2.100 | 2.117 |

for coordinates extending to a point where the tangent to the curve is parallel to a plate;

| | | | | | | | | | | |
|---|---|---|---|---|---|---|---|---|---|---|
| X | 5.083 | 5.399 | 5.571 | 5.750 | 6.047 | 6.179 | 6.3 | 6.423 | 6.474 | 6.486 |
| Y | 2.112 | 2.073 | 2.018 | 1.943 | 1.759 | 1.609 | 1.426 | 1.235 | 1.040 | 0.838 |

for coordinates extending to a point where the tangent to the curve is vertical; and

| | | | |
|---|---|---|---|
| X | 6.436 | 6.342 | 6.021 |
| Y | 0.648 | 0.515 | 0.447 |

for coordinates extending to the plate edge.

Figure 15:
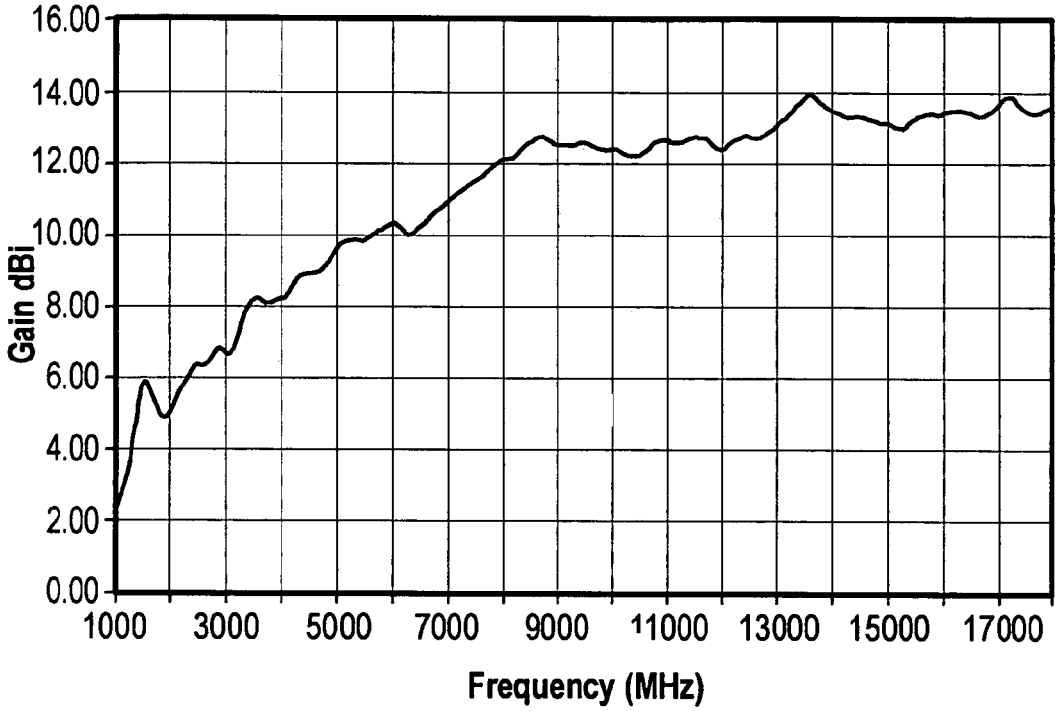
FIGS. 15, and 16 are charts of the gain, and VSWR versus frequency, respectively, for the preferred embodiment of the present invention.
Figure 16:
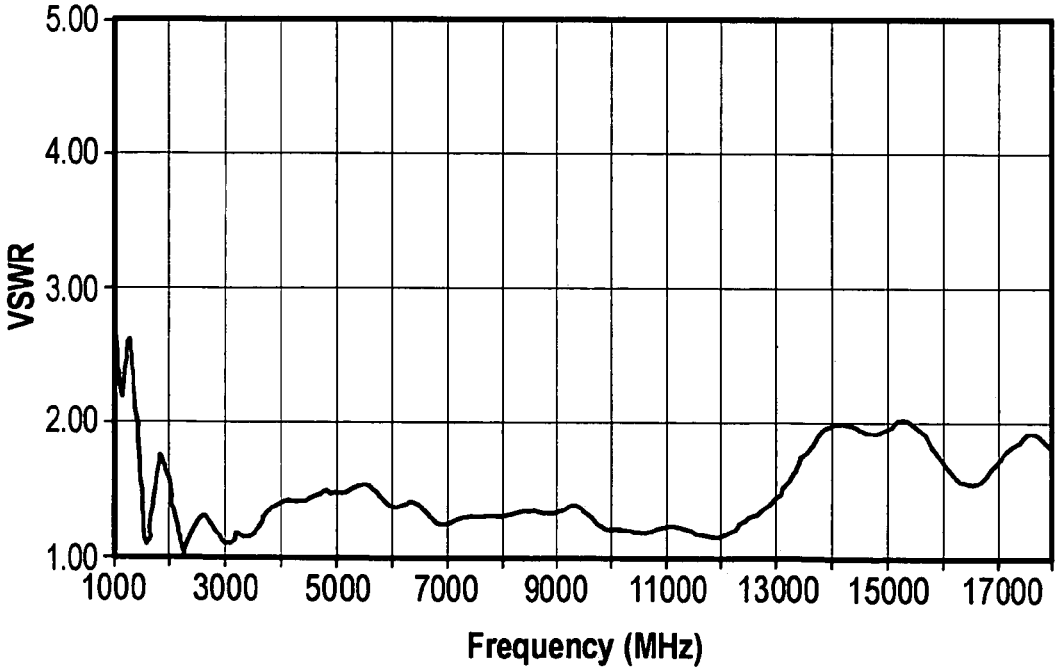

FIGS. 15, and 16 are charts of the gain, and VSWR versus frequency, respectively, for the preferred embodiment of the present invention. Clearly, comparing FIGS. 4 and 15, and FIGS. 5 and 16, a smoother gain curve is achieved by the present invention and a substantial improvement in gain is obtained at the highest frequency of operation, without a substantial sacrifice in VSWR.

Figure 1:
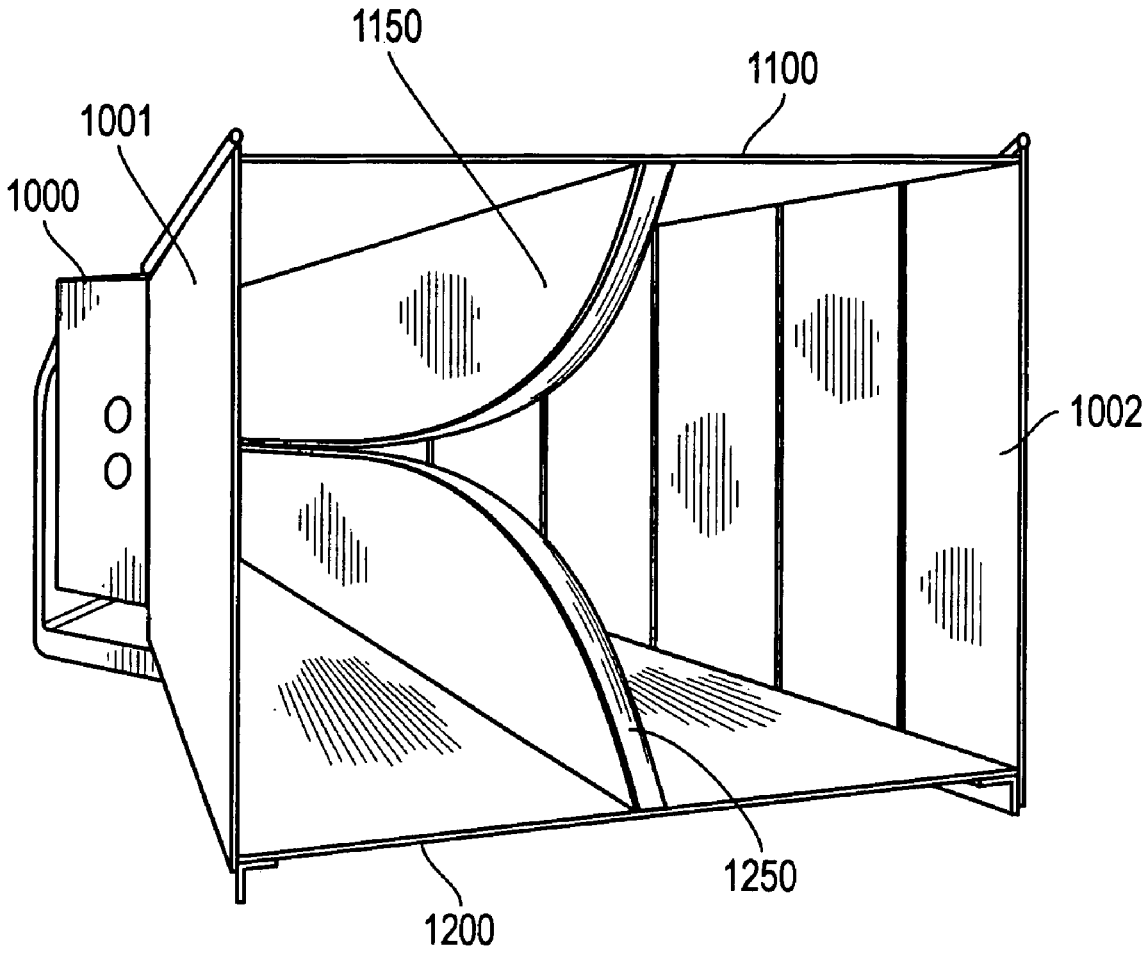
FIG. 1 (Prior Art)
FIG. 1 is a 3-dimensional view of a prior art ridged horn antenna.
Figure 2:
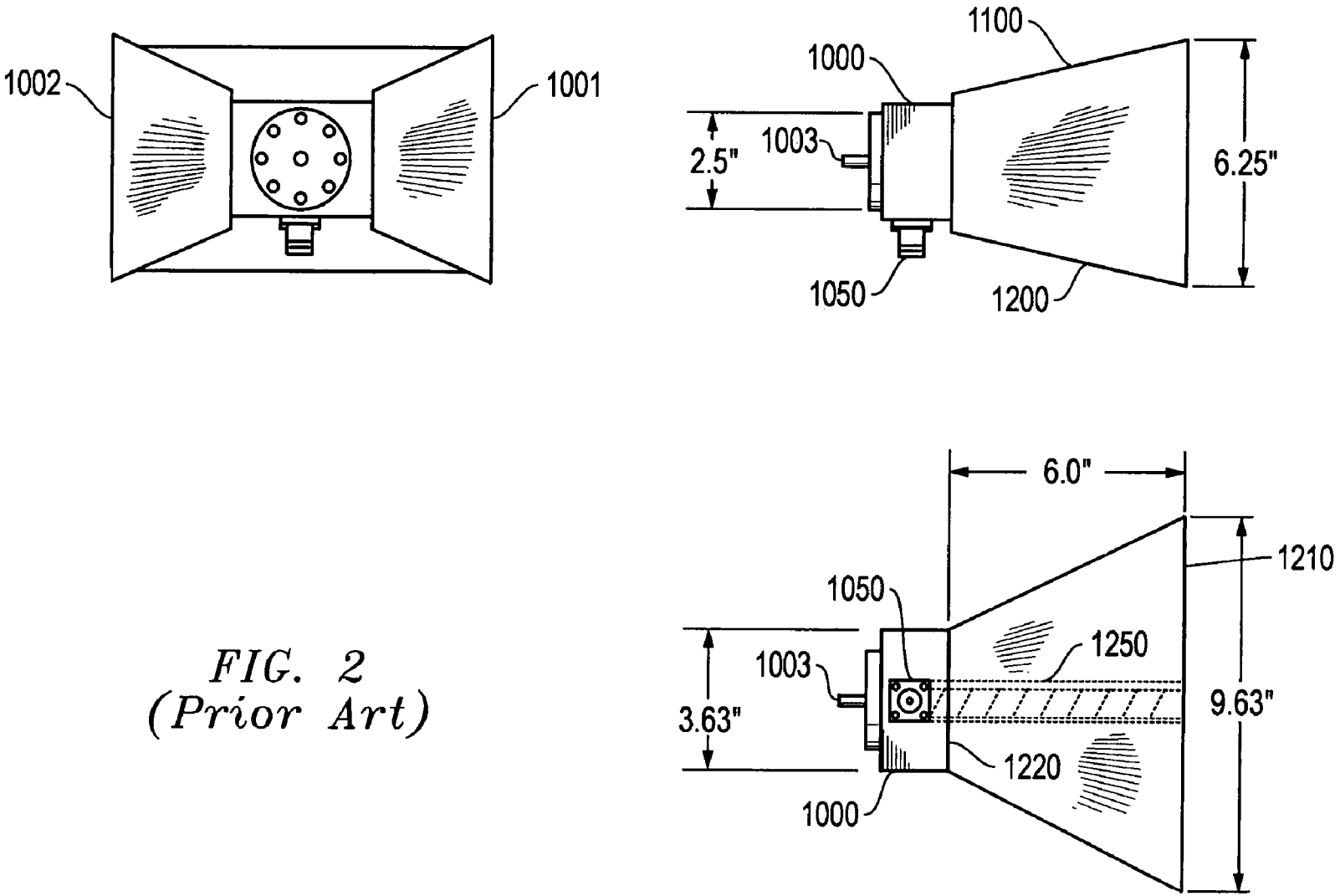
FIG. 2 (Prior Art)
FIG. 2 shows a bottom, side and rear view of the prior art ridged horn antenna of FIG. 1.
Figure 3:
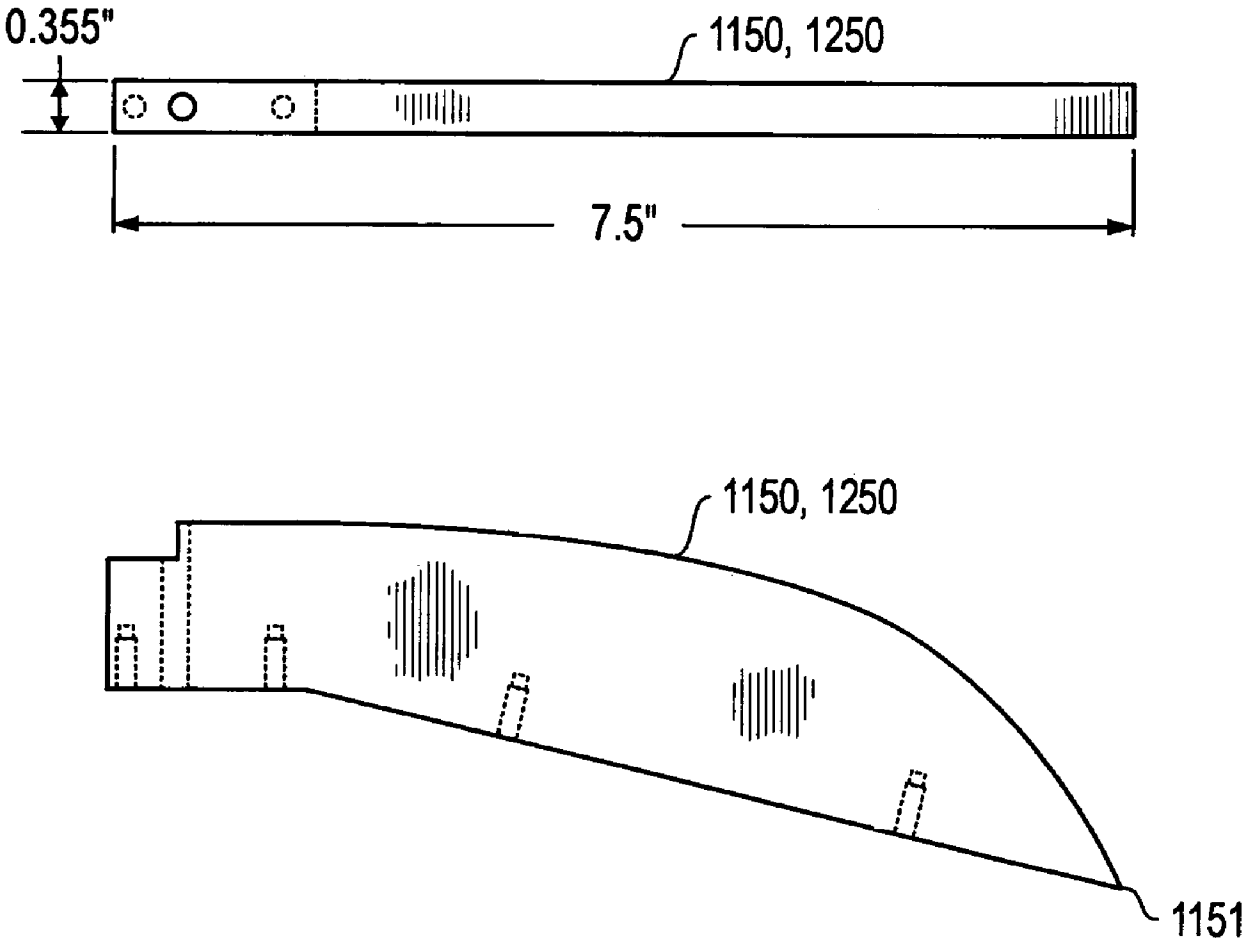
FIG. 3 (Prior Art)
FIG. 3 shows the side and edge view of a ridge employed in the prior art ridged horn antenna of FIG. 1.
Figure 4:
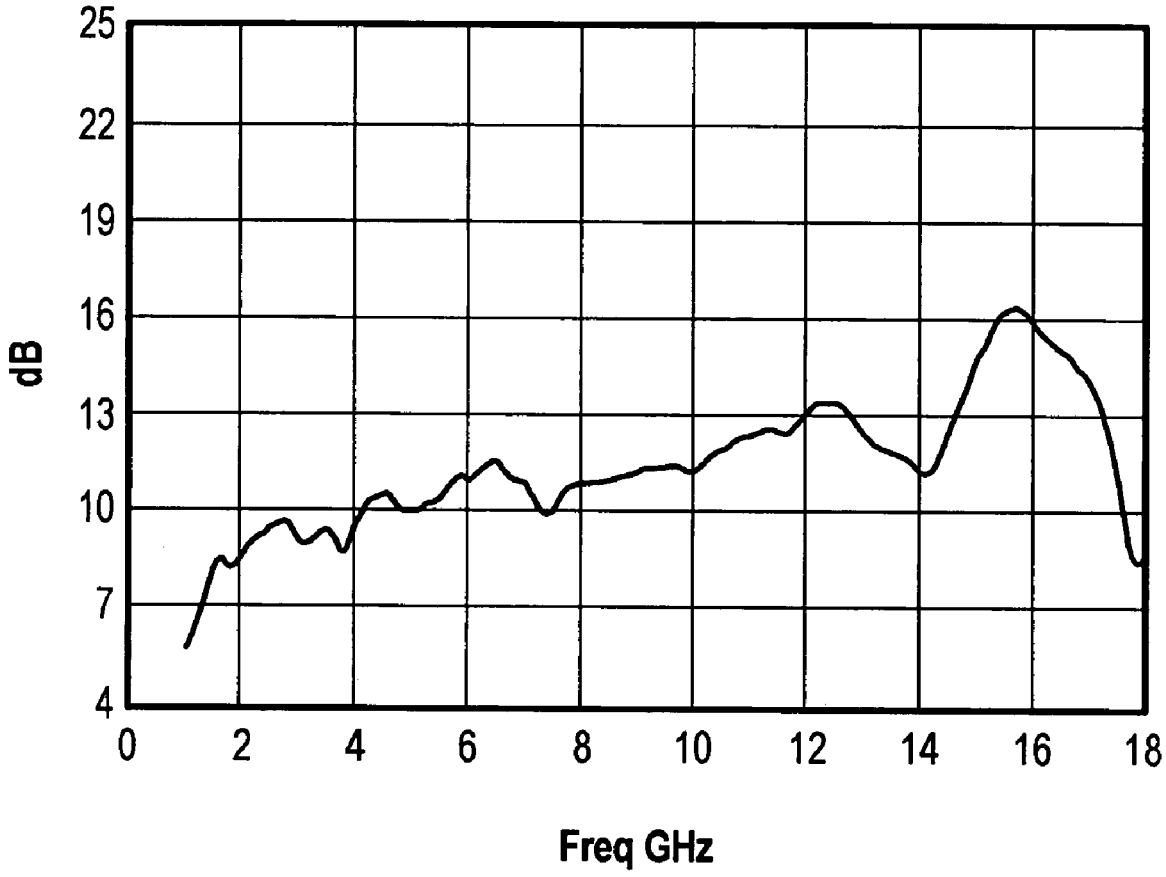
FIG. 4 (Prior Art)
FIGS. 4, 5, and 6 are charts of the gain, VSWR, and Half Power Beam width versus frequency, respectively, for the prior art antenna of FIG. 1.
Figure 5:
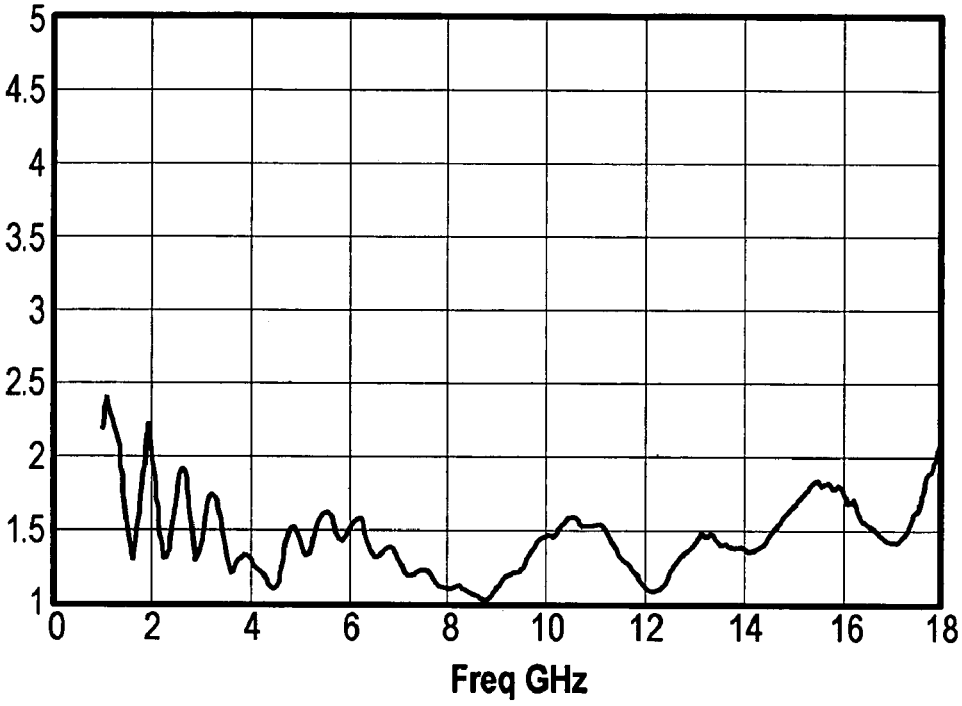
FIG. 5 (Prior Art)
Figure 6:
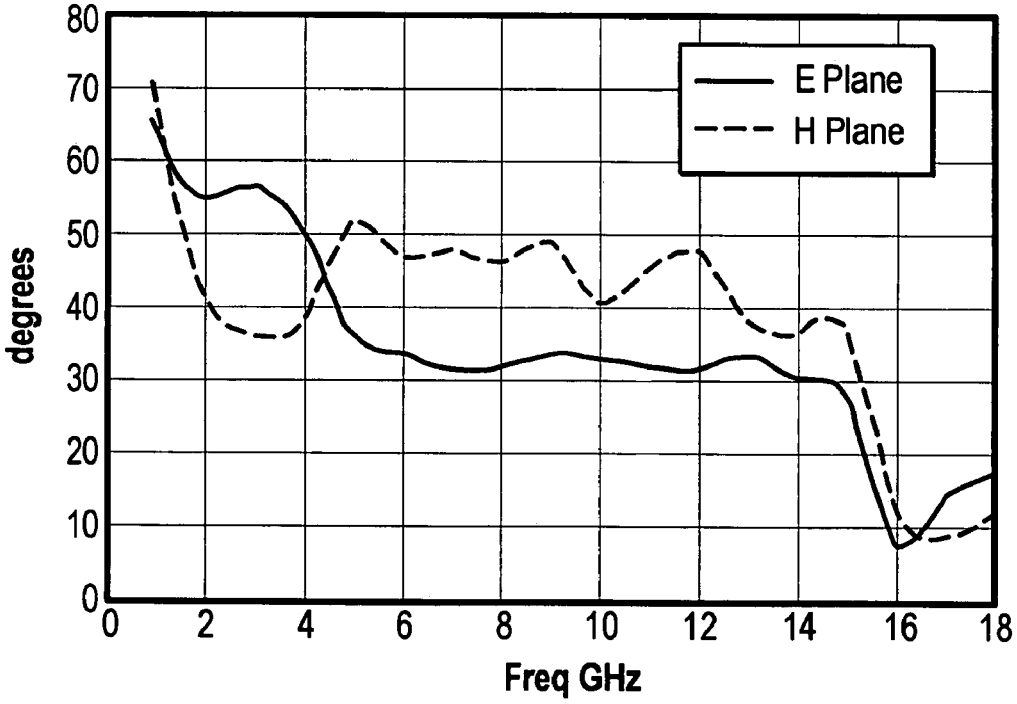
FIG. 6 (Prior Art)
Figure 7:
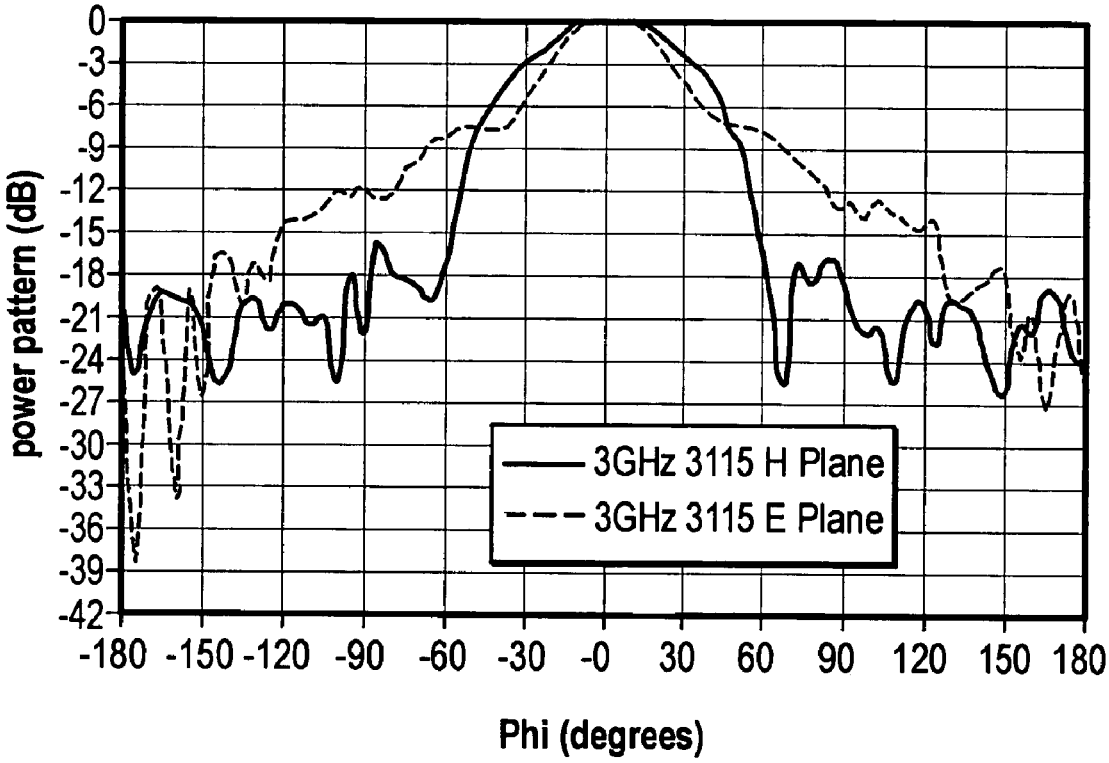
FIG. 7 (Prior Art)
FIGS. 7, 8, 9 show the normalized radiation patterns for prior art ridged horn antenna of FIG. 1 for 3, 12, and 17 gHz, respectively.
Figure 8:
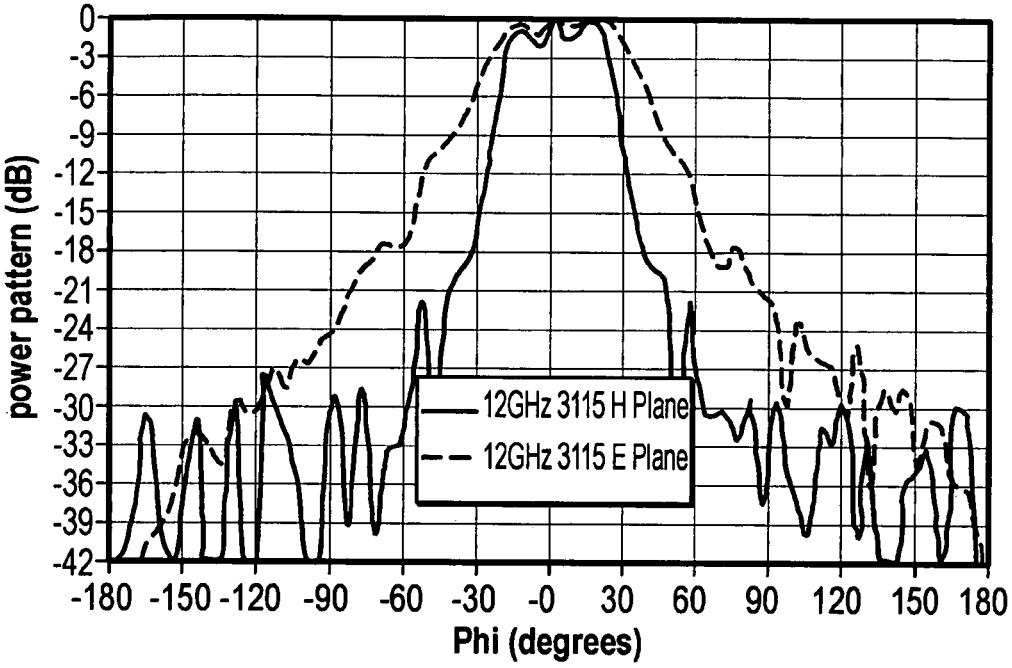
FIG. 8 (Prior Art)
Figure 9:
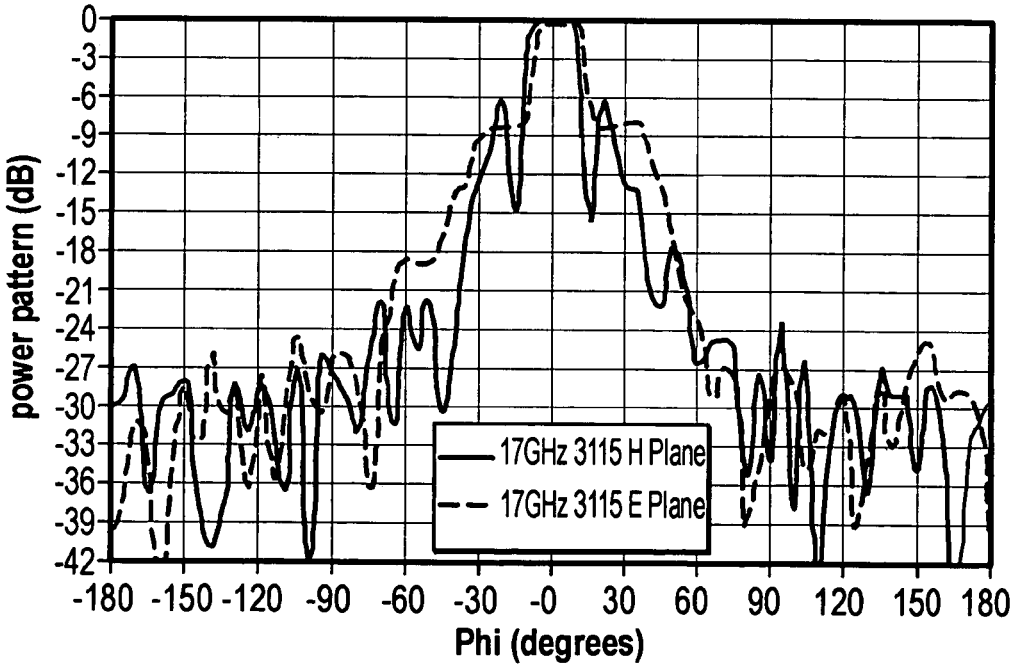
FIG. 9 (Prior Art)
Figure 17:
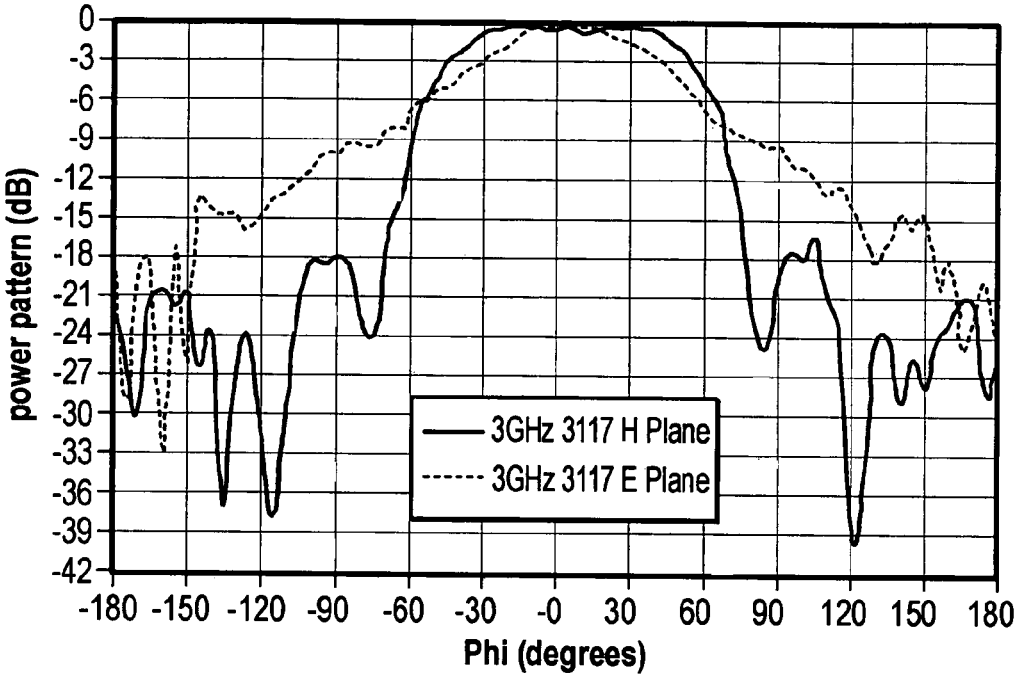
FIGS. 17, 18, 19 show the normalized radiation patterns for prior art ridged horn antenna of FIG. 1 for 3, 12, and 17 gHz, respectively.
Figure 18:
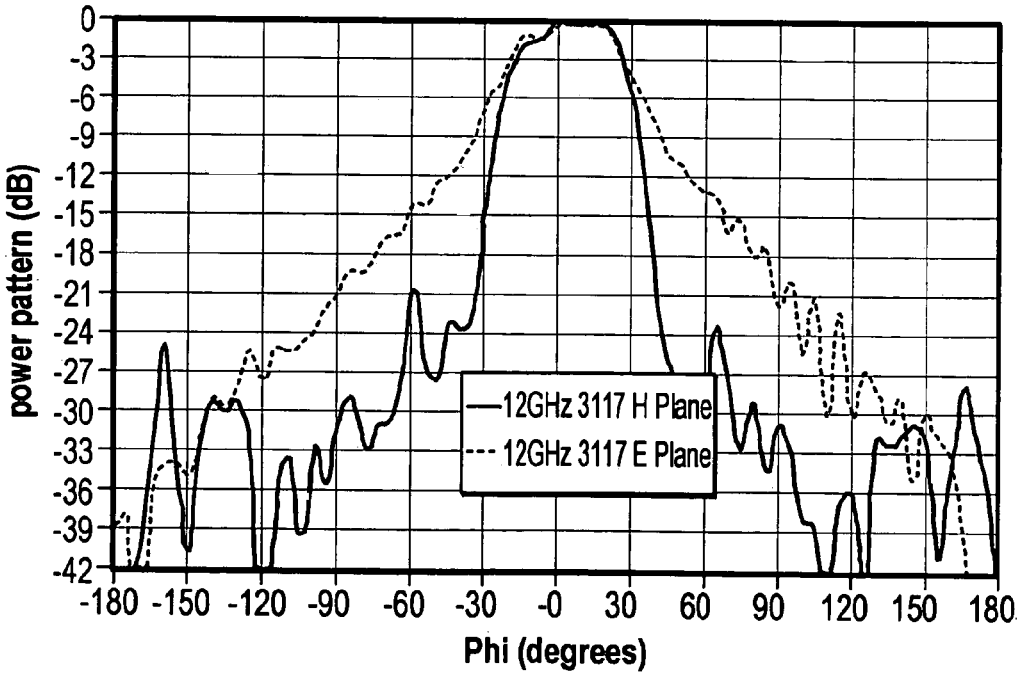
Figure 19:
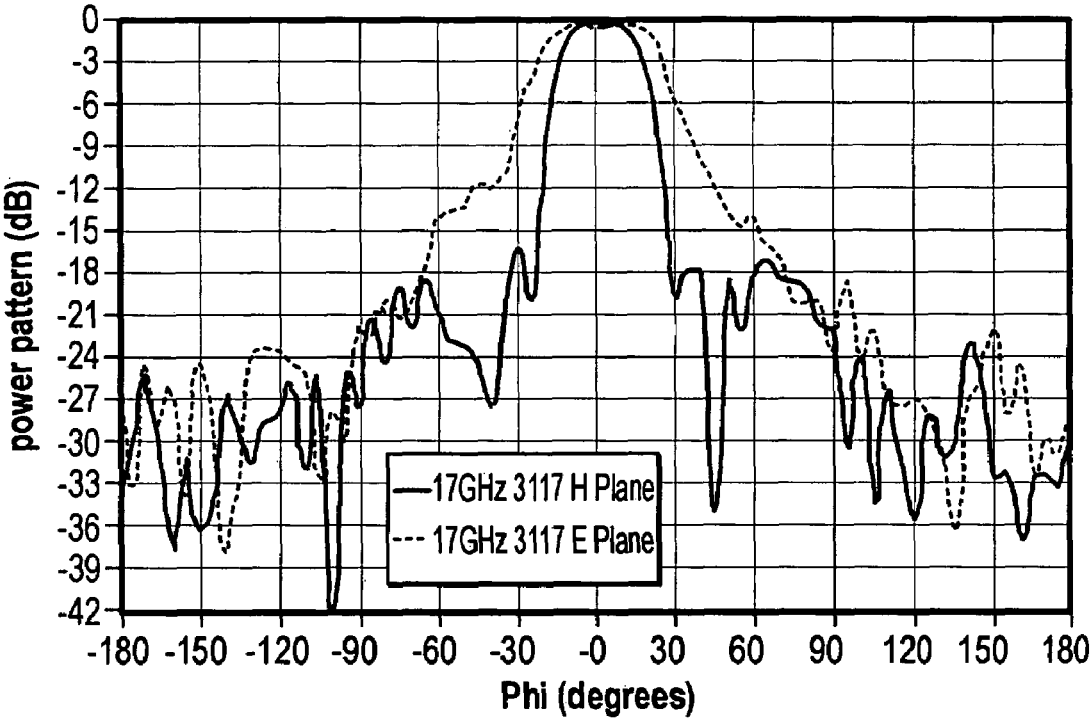

FIGS. 17, 18, 19 show the normalized radiation patterns for the preferred embodiment of the present invention for 3, 12, and 17 gHz, respectively. Comparing these to the corresponding plots for the prior art antenna shown in FIGS. 7, 8, and 9, a clear and substantial improvement in the main lobe is achieved. At 17 gHz the side lobe level has been reduced while the 3 dB beamwidth has been improved making the antenna more suitable for immunity EMC testing.

Figure 20:
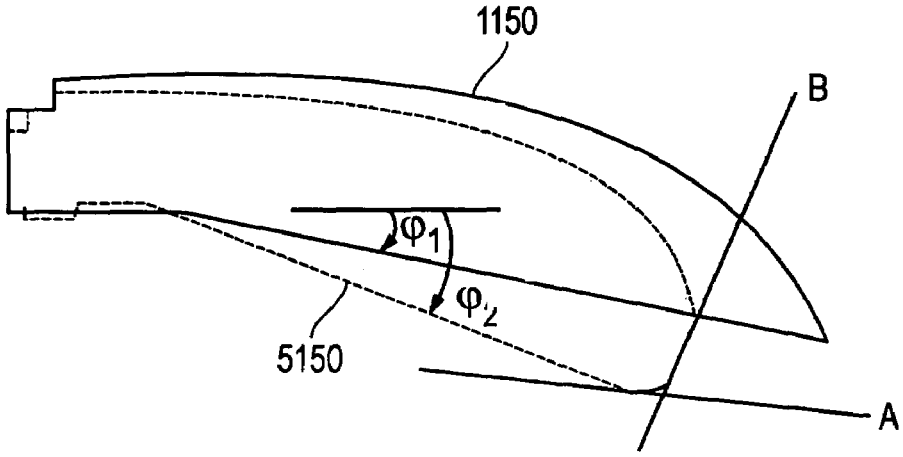
FIG. 20 shows a comparison between a ridge of the prior art and a ridge of a preferred embodiment of the present invention.

Shown in FIG. 20 is a comparison of ridge 1150 of the prior art Model 3115 and the ridge 5150 of the preferred embodiment of the present invention. Note that the angle of the prior art flare measured from the horizontal to the plate, $\phi$1, is about 13 degrees, whereas for the preferred embodiment, the angle of the flare measured from the horizontal to the plate, $\phi$2, is about 21 degrees.

Expressing the dimensions of the preferred embodiment in terms of fractions of a wavelength at the lowest frequency of operation, $\lambda_L$, in this instance, 1 gHz with $\lambda_L$=11.811 inches, we have as follows:

the length, L=6.977 inches, of the antenna is about $0.591\lambda_L$, compared to L=8.13 inches=$0.688\lambda_L$ for the Model 3115;

the aperture width, W=6.949 inches, of the antenna is about $0.588\lambda_L$, compared to W=9.63 inches=$0.82\lambda_L$ for the Model 3115; and the aperture height, H=6.036 inches, of the antenna about $0.511\lambda_L$, compared to H=6.25 inches=$0.53\lambda_L$ for the Model 3115.

Expressing the dimensions of the preferred embodiment in terms of fractions of a wavelength at the highest frequency of operation, $\lambda_H$, in this instance, 18 gHz with $\lambda_H$=0.656 inches, we have as follows:

the length, L=6.977 inches, of the antenna is about $10.63\lambda_H$, compared to L=8.13 inches=$12.39\lambda_H$ for the Model 3115;

the aperture width, W=6.949 inches, of the antenna is about $10.59\lambda_H$, compared to W=9.63 inches=$14.68\lambda_H$ for the Model 3115; and the aperture height, H=6.036 inches, of the antenna is about $9.20\lambda_H$, compared to H=6.25 inches=$9.52\lambda_H$ for the Model 3115.

Note that although the angle of the flare formed by upper and lower plates 5150 and 5250 of the preferred embodiment is much greater than the corresponding angle for the Model 3115, the aperture height, H, is about the same for both antennas, yet the antenna length and width has been shortened considerably in the present invention compared to the prior art.

Thus, although the present invention and its advantages have been described in detail, it should be understood that various changes, substitutions and alterations can be made herein without departing from the spirit and scope of the invention as defined by the appended claims. The invention achieves multiple objectives and because the invention can be used in different applications for different purposes, not every embodiment falling within the scope of the attached claims will achieve every objective.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A ridged pyramidal horn antenna, comprising:

a first conducting plate and a second conducting plate positioned to form an angle there between;

a first ridge in proximity to the first plate and a second ridge in proximity to the second plate; the first ridge extending beyond a distal end of the first plate, and the second ridge extending beyond a distal end of the second plate; and wherein a curvature of the first ridge exhibits an arc that is tangent to a line perpendicular to a surface of the first plate.

2. The antenna of claim 1, wherein:

a curvature of the second ridge exhibits an arc that is tangent to a line perpendicular to a surface of the second plate.

3. The antenna of claim 1, wherein:

a curvature of the first ridge exhibits an acute arc that terminates on a surface of the first plate and exhibits a tangent to a line perpendicular to a surface of the first plate.

4. A ridged horn antenna, comprising:

a first plate and a second plate positioned to form an angle there between;

a first ridge in proximity to the first plate and a second ridge in proximity to the second plate; wherein a curvature of the first ridge exhibits an arc that is tangent to a line perpendicular to a surface of the first plate, and a curvature of the second ridge exhibits an arc that is tangent to a line perpendicular to a surface of the second plate.

5. The antenna of claim 4, wherein the first plate exhibits an edge with a curvature that is symmetric with respect to the first ridge.

6. The antenna of claim 5, wherein the first ridge extends beyond the curved edge of the first plate.

7. The antenna of claim 5, wherein the second plate exhibits an edge with a curvature that is symmetric with respect to the second ridge.

8. The antenna of claim 7, wherein the second ridge extends beyond the curved edge of the second plate.

9. The antenna of claim 4, wherein the angle between the plates exceeds 39 degrees.

10. The antenna of claim 4, wherein a length of the antenna is about 10 wavelengths and an aperture width of the antenna is about 10 wavelengths at a high frequency of operation where the gain of the antenna is substantial.

11. The antenna of claim 10, wherein the length of the antenna is about ½ wavelength and the aperture width of the antenna is about ½ wavelength at a low frequency of operation where the gain of the antenna is substantial.

12. The antenna of claim 4, wherein a length of the antenna is about ½ wavelength and an aperture width of the antenna is about ½ wavelength at a low frequency of operation where the gain of the antenna is substantial.

13. A broad-band method for transmitting or receiving electromagnetic energy using a ridged horn antenna, comprising:

positioning a first plate in proximity to a second plate and forming an angle there between with an edge of the first plate exhibiting a non-linear curvature that is symmetric about a center line of the first plate and with an edge of the second plate exhibiting a non-linear curvature that is symmetric about a center line of the second plate; and positioning a first ridge along the center line of the first plate and positioning a second ridge along the center line of the second plate.

14. The method of claim 13, wherein a curvature of the first ridge exhibits an arc that is tangent to a line perpendicular to a surface of the first plate, and a curvature of the second ridge exhibits an arc that is tangent to a line perpendicular to a surface of the second plate.

15. The method of claim 13, wherein the angle between the plates exceeds 41 degrees.

16. The method of claim 13, wherein the angle between the plates exceeds 34 degrees.

17. The method of claim 13, wherein a length of the antenna is about 10 wavelengths and an aperture width of the antenna is about 10 wavelengths at a high frequency of operation where the gain of the antenna is substantial.

18. The method of claim 16, wherein the length of the antenna is about ½ wavelength and the aperture width of the antenna is about ½ wavelength at a low frequency of operation where the gain of the antenna is substantial.

19. The method of claim 13, wherein the first plate exhibits opposite edges forming an angle that exceeds 48 degrees, and wherein the second plate exhibits opposite edges forming an angle that exceeds 48 degrees.

20. The method of claim 13, wherein the first plate exhibits opposite edges forming an angle that exceeds 39 degrees, and wherein the second plate exhibits opposite edges forming an angle that exceeds 39 degrees.

* * * * *